US005432384A

United States Patent [19]

Isozumi et al.

[11] Patent Number: 5,432,384

[45] Date of Patent: Jul. 11, 1995

[54] STARTER MOTOR

[75] Inventors: Shuzo Isozumi; Kyohei Yamamoto; Hayato Yamauchi, all of Himeji, Japan

[73] Assignee: Mitsubishi Denki Kabushiki Kaisha, Tokyo, Japan

[21] Appl. No.: 197,715

[22] Filed: Feb. 17, 1994

[30] Foreign Application Priority Data

Feb. 26, 1993 [JP] Japan ..... 5-063491

[51] Int. Cl.[6] ..... F02N 11/00

[52] U.S. Cl. ..... 290/48; 74/7 R; 74/7 A

[58] Field of Search ..... 74/7 R, 7 A; 290/36 R, 290/48

[56] References Cited

U.S. PATENT DOCUMENTS 4,304,140 12/1981 Kohei ..... 74/7 R
4,818,889 4/1989 Kinoshita ..... 290/48
4,860,604 8/1989 Kinoshita ..... 74/7 E
4,995,275 2/1991 Okamoto et al. ..... 74/7 A

FOREIGN PATENT DOCUMENTS 2613777 10/1988 France ..... 290/48
92750 7/1981 Japan .
2616663 11/1986 Japan .

*Primary Examiner*—A. D. Pellinen
*Assistant Examiner*—Robert Lloyd Hoover
*Attorney, Agent, or Firm*—Sughrue, Mion, Zinn, Macpeak & Seas

[57] ABSTRACT

In an overhang type starter motor, an inner periphery of a front portion of a pinion 5 is engaged with a spline serration 2*a* formed at a front part of a pinion shaft 2; a spring 8 is disposed at a shoulder portion of an intermediate portion of the pinion 5 so as to urge the pinion 5 toward a pinion stopper 6; and the inner periphery of the rear part 5*a* of the pinion 5 is in slide contact with an outer diameter portion 2*b* of the pinion shaft so that the pinion does not incline when it comes to engagement with a ring gear of an engine.

2 Claims, 6 Drawing Sheets

STARTER MOTOR

BACKGROUND OF THE INVENTION

1. Field of the Invention

The present invention relates to an improvement of engagement between a pinion attached to an output shaft of an overhang type starter motor and a ring gear.

2. Discussion of Background

FIG. 4 is a cross-sectional view of an important portion of an output side of a conventional overhang type starter motor disclosed in, for instance, Japanese Unexamined Patent Publication No. 97576/1991.

In FIG. 4, reference numeral 1 designates an overrunning clutch in which a clutch outer is spline-engaged with a rotary output shaft. A torque produced in the clutch outer is transmitted to a clutch inner formed integrally with a pinion shaft 2 by means of a roller or the like. The pinion shaft 2 is supported so as to be slidable in the axial direction by means of a ball bearing 3 which is fitted to a front bracket 4. A pinion 5 is spline-engaged with a straight spline 2*a* formed in the pinion shaft 2 at a front side of the ball bearing 3. The overhang type starter motor is derived from a structure that the pinion 5 is located in front of a part for supporting the rotary shaft.

A pinion stopper 6 and a ring 7 are disposed to restrict a movement of the pinion 5 in a forward direction. The pinion 5 is urged toward the pinion stopper 6 by means of a spring 8.

Numeral 9 designates a plunger which constitutes a part of an electromagnetic switch. When the plunger 9 is attracted, a lever 10 is turned around a pivotal point in a counterclockwise direction to thereby urge the overrunning clutch 1 in the forward direction. Numeral 11 designates a ring gear provided in the side of an internal combustion engine.

A character X represents a clearance between the outer periphery 2*b* of the pinion shaft and the inner periphery 5*a* at a rear portion of the pinion, the clearance being usually set to be about 0.55 mm. A character Y represents a clearance between the outer periphery of the pinion 5 and the inner periphery of the front bracket 4, the clearance Y being usually set to be about 1.5 mm.

The operation of the conventional starter motor will be described.

When a switch coil (not shown) is excited whereby the plunger 9 of the electromagnetic switch is attracted, the lever 10 is turned in the counterclockwise direction and the overrunning clutch 1 is urged forwardly. Then, the pinion shaft 2 is slidably moved forwardly while it is supported by the bearing 3. The sliding movement of the pinion shaft 2 brings an end surface of the pinion 5 spline-engaged with the pinion shaft 2 into contact with the ring gear 11. Then, the pinion 5 is engaged with the ring gear 11 with deflection of the spring 8.

Thereafter, a switch contact (not shown) is closed to start the revolution of a motor shaft, and a rotating force of the motor shaft is transmitted to the overrunning clutch 1. The rotating force of the pinion shaft 2 which constitutes a part of the overrunning clutch 1 is transmitted to the pinion 5 through the serration of the spline 2*a* so that the ring gear 11 of the engine is rotated.

The engagement of the pinion 5 with the ring gear 11 is conducted by using an auxiliary rotation type intermeshing mechanism which is so operated that when the end surface of the pinion 5 becomes in contact with the end surface of the ring gear 11, a main contact of a switch (not shown) is not closed but a current flowing in an exciting coil of the switch is supplied to a motor (not shown), whereby the motor produces a torque which causes rotation by overcoming a friction between the end surfaces of the pinion 5 and the ring gear 11. Then, the pinion 5 is turned for one pitch by the torque, whereby the pinion 5 is engaged with the ring gear 11. When the pinion 5 is engaged with the ring gear 11 over the total face width, the main contact of the switch is closed to produce a full starting torque. Thus, the ring gear 11 is rotated.

In the conventional starter motor having the above-mentioned construction, the pinion 5 located on the pinion shaft 2 has the following problem. An inclination of the pinion 5 at the time of engagement with the ring gear 11 is mainly determined by the tooth crest, the bottom land or the tooth surface of the serration of the spline 2*a*, namely, the inclination of the pinion 5 is restricted only by a fitting portion in the serration of the spline 2*a*. Since the serration has a backlash (in particular, the serration is formed by rolling or cold forging whereby there is a limitation to improve precision of processing) and the dimension of the clearance X is relatively large as 0.55 mm, there is a tendency that the spring 8 is inclined when the pinion 5 is brought to contact with the end surface of the ring gear 11 (as shown in FIG. 5).

When the spring 8 is inclined, a point contact state between the pinion 5 and the ring gear 11 is created at their end surfaces. The portion having a point contact between the pinion 5 and the ring gear 11 is apt to cause a damage, and the frictional coefficient at the contacting point is apt to be large when the torque for turning the pinion 5 for one pitch is produced. Accordingly, it is difficult to obtain the one pitch rotation of the pinion and a fault of starting may possibly occur. Further, even after the pinion 5 was engaged with the ring gear 11, the transmission of the torque through the tooth surfaces of the pinion 5 is not stable due to looseness of the pinion 5, with the result of generation of noises and the wearing of the tooth surfaces of the pinion.

Since a load applied to the tooth surfaces of the pinion 5 is born by the serration portion of the pinion shaft 2 by means of the spline serration 2*a*, a span Li between the bearing 3 for supporting the pinion shaft 2 and a point under load is long as shown in FIG. 5, so that there is a problem from the viewpoint of the strength of the pinion shaft.

Further, the inclination of the pinion 5 might cause interference between the outer periphery of the pinion 5 and the inner peripheral portion 4*a* of the front bracket. Accordingly, it is necessary to set the value of the clearance Y to be large. When the clearance Y is made large, a dust-proof function decreases so that dust deposits on the outer circumferential surface of the pinion shaft 2. This might cause a fault of sliding movement of the pinion shaft 2.

SUMMARY OF THE INVENTION

It is an object of the present invention to provide an overhang type starter motor wherein the engaging properties of a pinion disposed at an output side of the starter motor with a ring gear is improved.

The foregoing and other objects of the present invention have been attained by providing a starter motor comprising a front bracket, a pinion shaft slidably supported by the front bracket by interposing a bearing between the pinion shaft and the front bracket, and a pinion disposed on the pinion shaft in front of the bearing so as to come to engagement with a ring gear of an engine when the pinion is urged forwardly, wherein a front end portion at an inner periphery of the pinion is engaged with a spline portion formed at an end of the pinion shaft; a spring interposed between a shoulder portion formed in the pinion shaft and a shoulder portion formed at an intermediate portion of the inner periphery of the pinion to push the pinion toward a pinion stopper, and a rear portion of the inner periphery of the pinion is formed to have slide contact with an outer periphery of the pinion shaft so that the movement of the pinion in the radial direction is controlled.

According to the starter motor of the present invention, the inner periphery at the rear portion of the pinion attached to an end of the pinion shaft is in slide-contact with the outer diameter portion of a slide-movement portion of the pinion shaft so that the movement of the pinion in the radial direction is controlled.

Accordingly, the inclination of the pinion is eliminated when the pinion is brought to contact with the ring gear, and a surface contact can be maintained between the pinion and the ring gear to thereby prevent occurrence of a flaw. Further, a friction to a torque for rotating the pinion for one pitch can be reduced, and a smooth engagement is assured.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
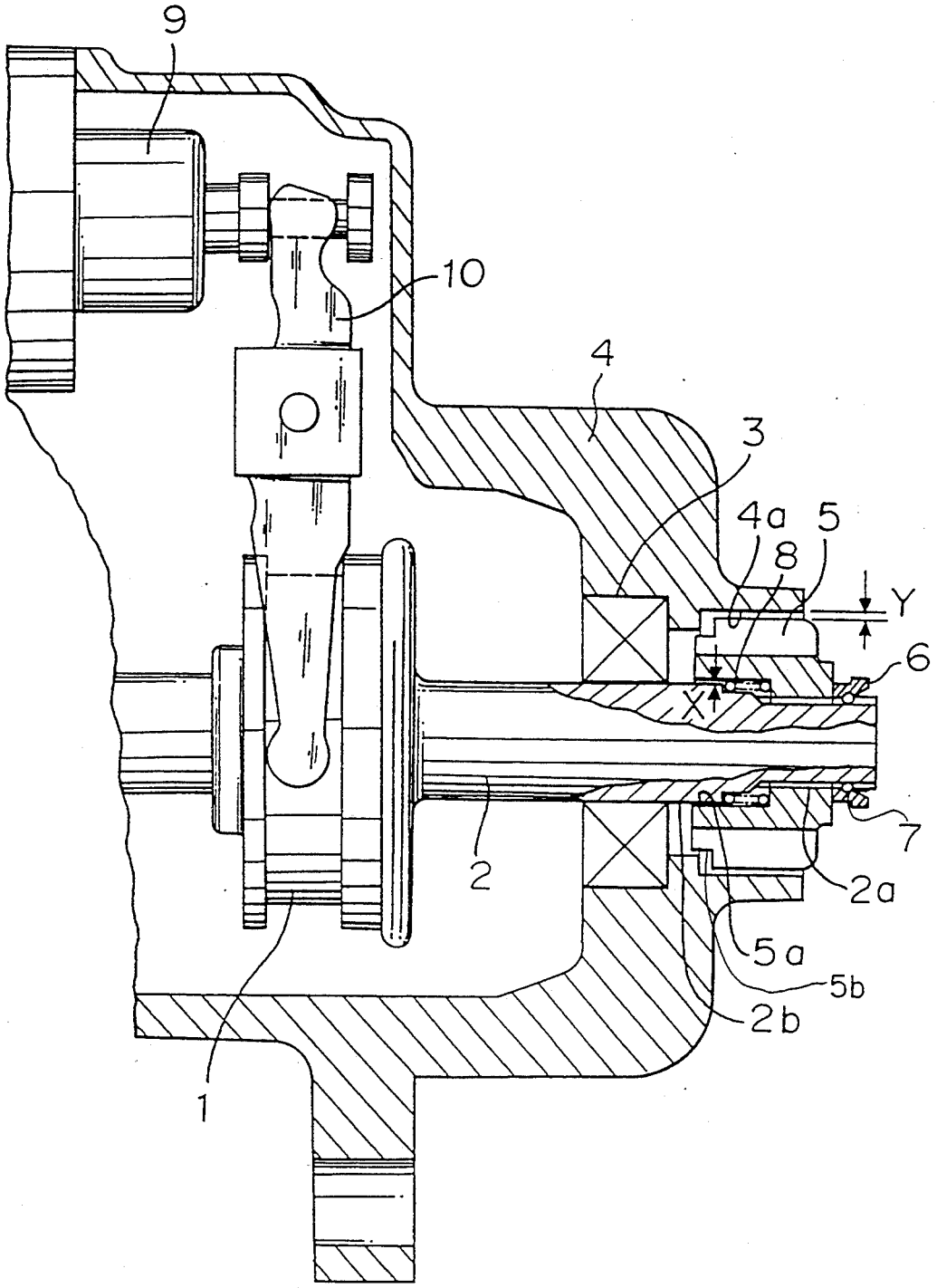
FIG. 1 is a longitudinal cross-sectional view of an important portion of an embodiment of the starter motor according to the present invention.
Figure 4:
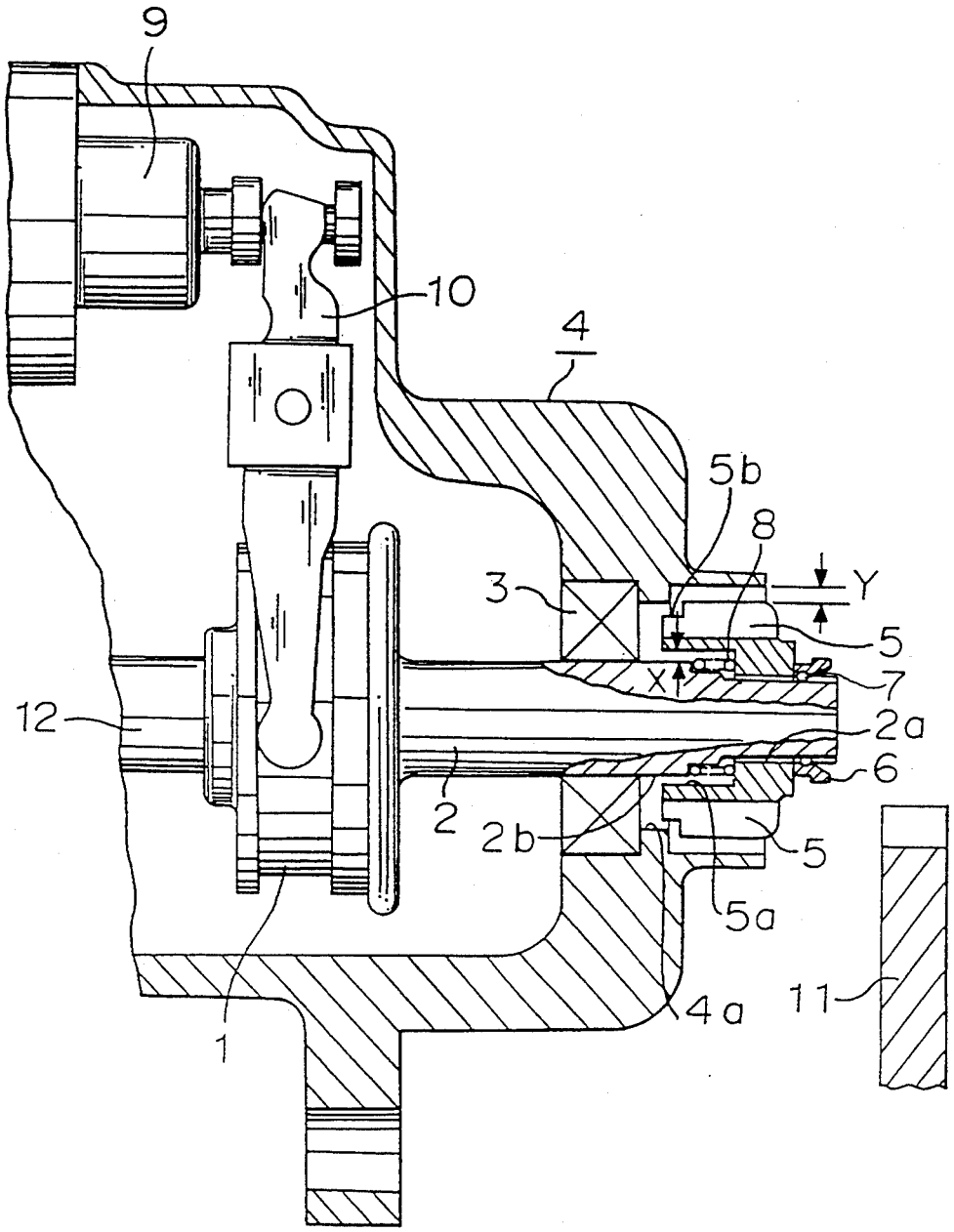
FIGURE 4 PRIOR ART
FIG. 4 is a longitudinal cross-sectional view of a conventional starter motor.

Preferred embodiments of the overhang type starter motor according to the present invention will be described with reference to the drawings. In FIG. 1 showing an output side of the overhang type starter motor according to an embodiment of the present invention, numeral 1 designates an overrunning clutch, numeral 2 designates a pinion shaft, numeral 3 designates a bearing, numeral 4 designates a front bracket, numeral 5 designates a pinion, numeral 6 designates a pinion stopper, numeral 7 designates a ring, numeral 8 designates a spring, numeral 9 designates a plunger, and numeral 10 designates a lever. The construction of these elements is the same as those of the conventional starter motor shown in FIG. 4.

In the embodiment shown in FIG. 1, a clearance X between an inner periphery 5*a* at a rear portion of the pinion 5 attached to the pinion shaft 2 and the outer diameter 2*b* of the pinion shaft 2 is determined to be a minute value (about 0.05 mm) so that the inner periphery 5*a* of the rear portion of the pinion 5 is in slide-contact with the outer diameter 2*b* of the pinion shaft 2. By the determination of the clearance X to keep a minute gap between the pinion 5 and the pinion shaft 2, the inclination of the pinion 5 is restricted. In particular, when the pinion 5 is engaged with a ring gear attached to an engine, the inclination of the pinion 5 can be prevented by the slide movement of the inner periphery 5*a* of the rear portion of the pinion 5 to the outer diameter portion 2*b* of the pinion shaft.

In the same manner as the conventional starter motor, an inner periphery at a front portion of the pinion 5 is engaged with a spline 2*a* formed at a front end portion of the pinion shaft 2, and a spring 8 is disposed between a shoulder portion formed at an intermediate portion in the inner periphery of the pinion 5 and a shoulder portion formed in the pinion shaft 2. In the present invention, since the clearance X is determined to have a minute gap, there is no possibility that the spring 8 inclines between the shoulder portion of the pinion 5 and the shoulder portion of the pinion shaft 2, and it is compressed regularly.

Further, it is possible to determine a clearance Y between an inner surface 4*a* of the front bracket 4 and an outer periphery of the pinion 5 to have a smaller value such as about 1.0 mm.

Figure 2:
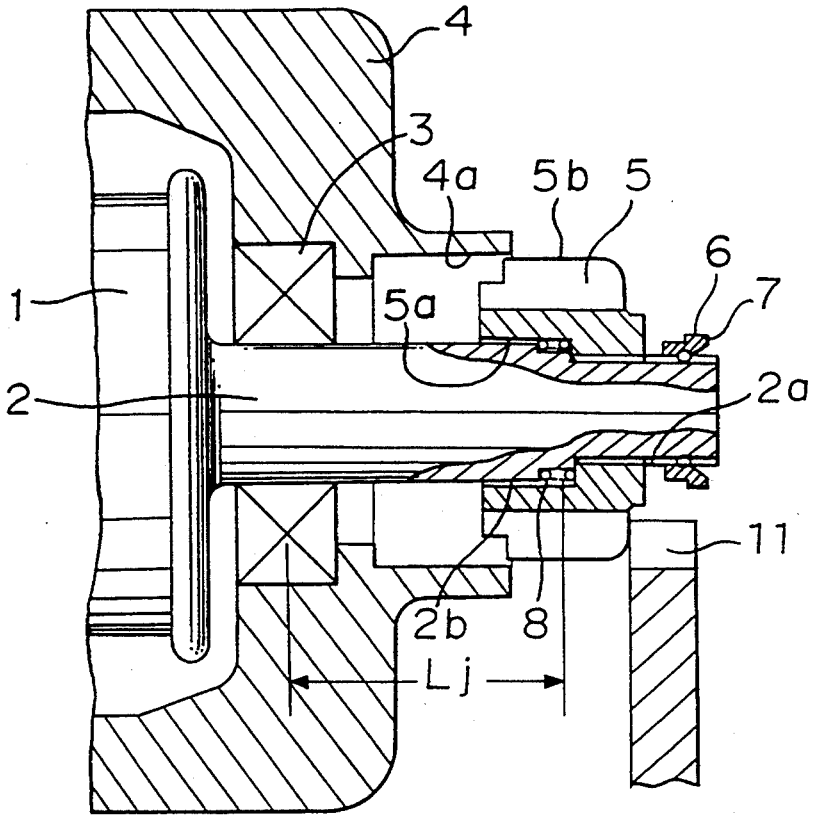
FIG. 2 is a longitudinal cross-sectional view of the starter motor of the present invention in which a state of engagement between a pinion and a ring gear is shown.

FIG. 2 shows a contacting state between the pinion 5 and the ring gear 11 in the above-mentioned embodiment. When the pinion 5 comes in contact with the ring gear, there is little inclination of the pinion 5 since the inclination of the pinion 5 is restricted by the slide movement of the inner periphery at the rear portion of the pinion 5 to the outer diameter portion 2*b* of the pinion shaft 2, and the pinion 5 can smoothly slide at the end surface of the ring gear 11, whereby the engaging property are improved.

Further, since an uneven force is not applied to the serration portion of the spline 2*a*, uneven wearing in the pinion and/or the serration of the spline 2*a* can be suppressed.

Figure 5:
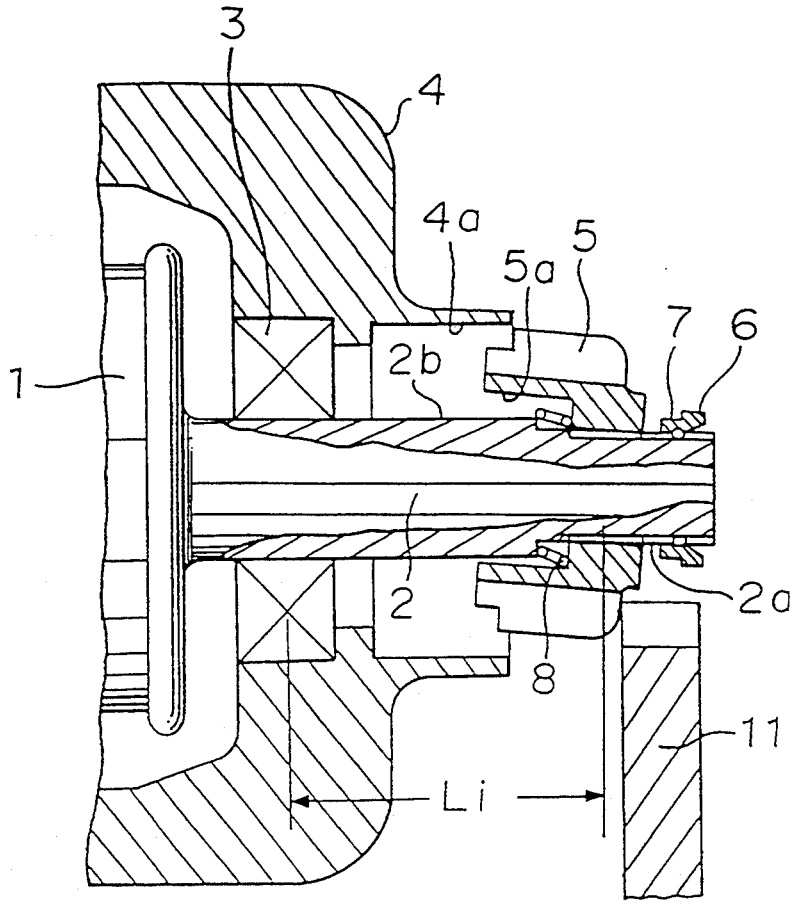
FIGURE 5 PRIOR ART
FIG. 5 is a longitudinal cross-sectional view of the conventional starter motor in which a state of engagement between a pinion and a ring gear is shown.

Since a load applied to the pinion 5 is born by the spline serration 2*a* of the pinion shaft and a sliding portion formed between the inner periphery of the rear portion of the pinion and the pinion shaft, an average length of a span Lj with respect to the bearing 3 can be reduced in comparison with the length of the span Li of the conventional starter motor (FIG. 5), whereby a bending moment at the bearing can be reduced.

Further, by minimizing the inclination of the pinion 5, the clearance Y formed between the outer periphery 5*b* of the pinion and the inner surface 4*a* of the front bracket can be small, so that invasion of foreign matters can be prevented and a dust-proof function can be sufficiently performed. The serration portion of the spline 2*a* can be formed by rolling or cold forging. In this case, the outer diameter of the sliding portion of the pinion shaft is processed with a grinder or the like whereby accurate dimensions are obtainable, and looseness of the pinion 5 to the pinion shaft can be eliminated as well as improving accuracy in the serration portion.

Figure 3:
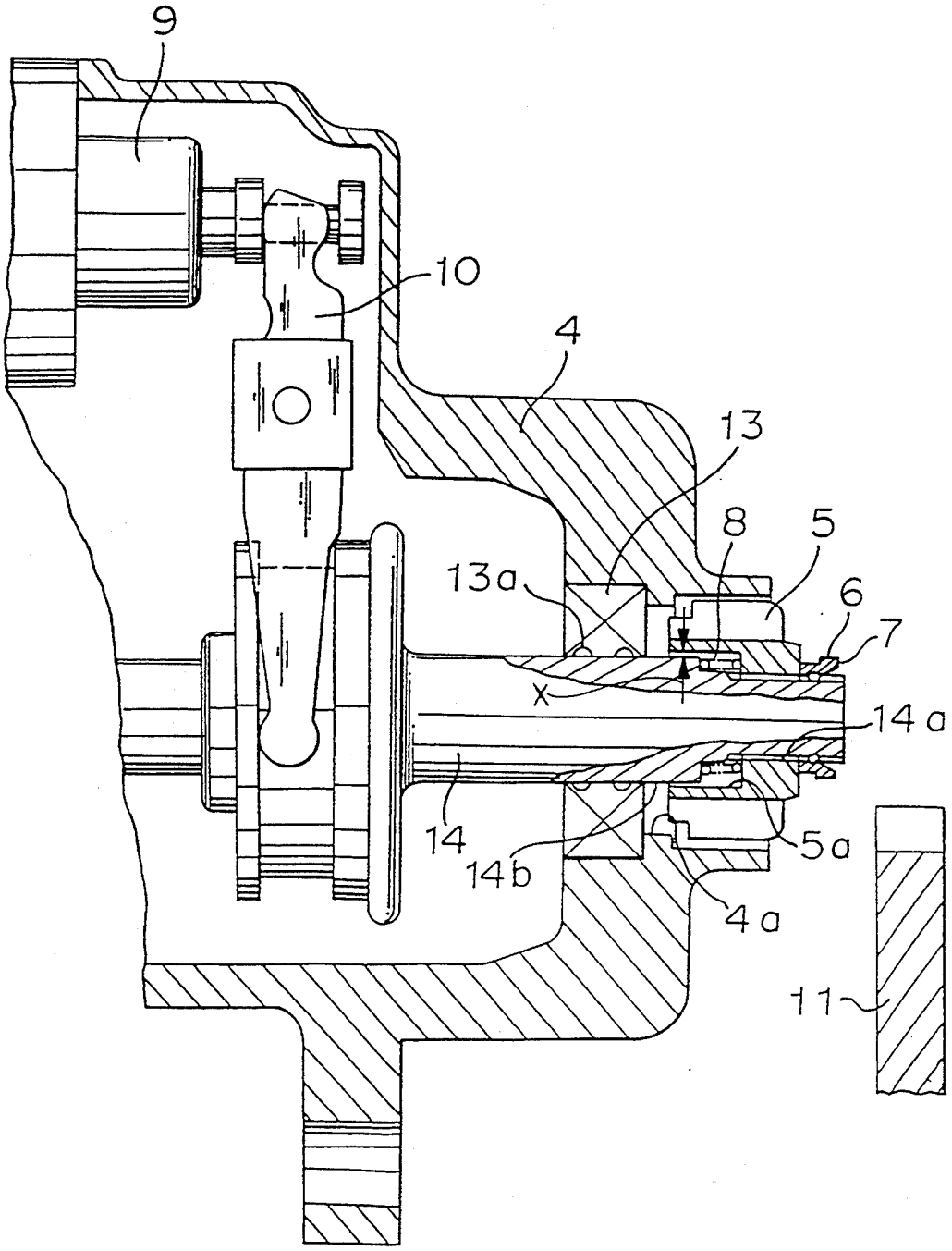
FIG. 3 is a longitudinal cross-sectional view of an important portion of another embodiment of the starter motor according to the present invention.
Figure 6:
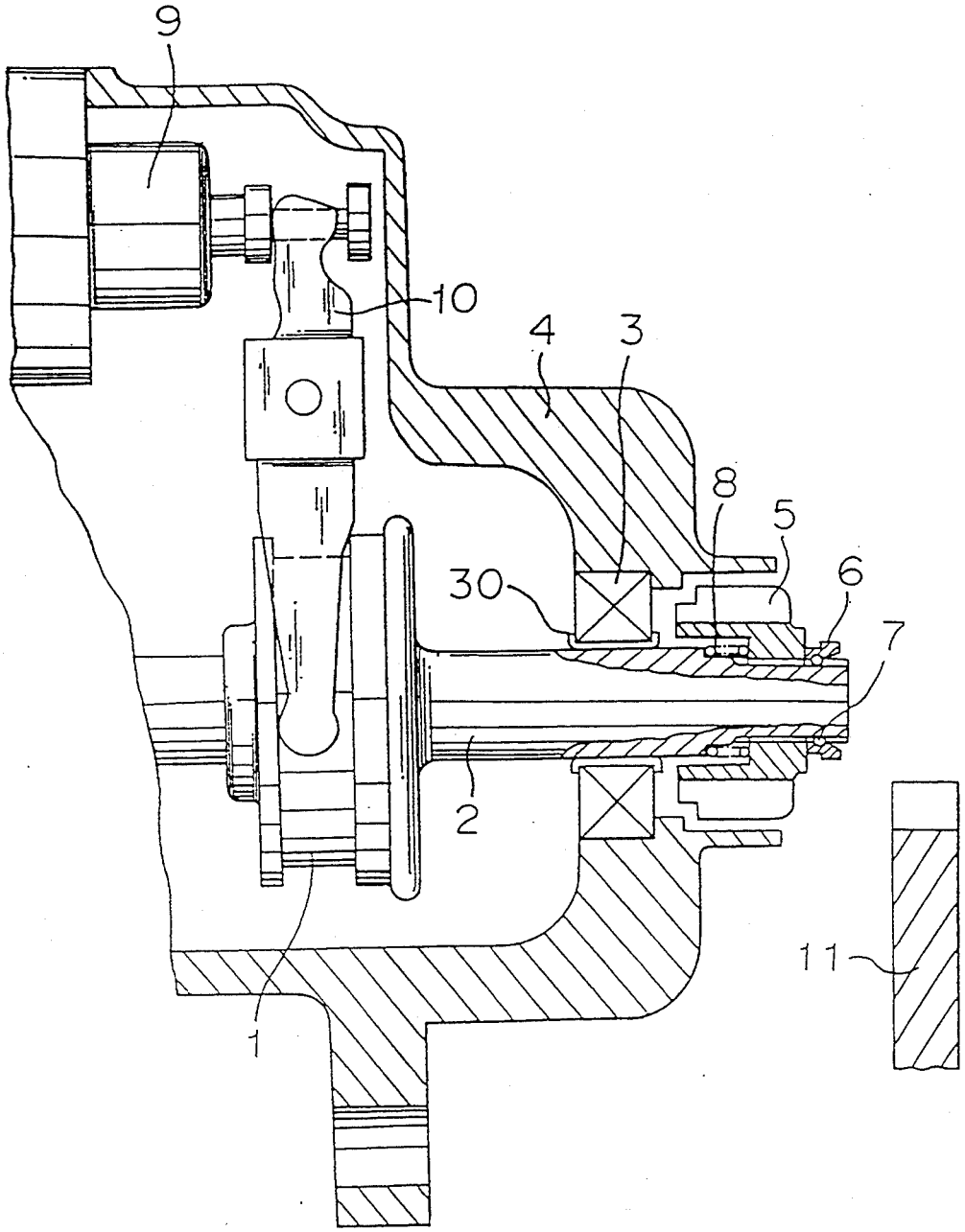
FIGURE 6 PRIOR ART
FIG. 6 is a longitudinal cross-sectional view showing another conventional starter motor.

In the conventional starter motor, a metal 30 is provided in an inner periphery of the bearing 3 to assist a smooth slide movement of the pinion shaft 2 as shown in FIG. 6. In a second embodiment of the starter motor according to the present invention, a bearing 13 with oil grooves 13*a* is disposed at a portion for supporting a pinion shaft 14, instead of the metal 30 used for the conventional starter motor (FIG. 3). Thus, by using the bearing 13 with oil grooves 13*a* instead of the metal 30, the diameter of the pinion shaft 14 can be determined to be large for the thickness of the metal 30, and the clearance X between the outer periphery 14*b* of the pinion shaft and the inner periphery 5*a* of the rear portion of the pinion 5 can be determined to be small. According to the second embodiment of the present invention, the same effect as the first embodiment can be attained.

In the second embodiment, since the strength of the pinion shaft 14 is increased and a shoulder portion which provides a seat for the spring 8 can be determined to be large, inserting properties for the spring 8 can be improved, and the inclination of the spring 8 can also be prevented.

In accordance with the present invention, the engaging properties of the pinion can be improved, and the wearing resistances of the pinion, the spline serration and the ring gear can be improved. Therefore, the lifetime of these elements can be prolonged. Further, since a bending moment to the pinion shaft at a bearing portion can be reduced, the strength of the pinion shaft is improved. Further, a dust-proof to the bearing can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor, comprising:

a front bracket;

a pinion shaft slidably supported by the front bracket through the interposition of a bearing disposed between the pinion shaft and the front bracket;

a pinion disposed on the pinion shaft in front of the bearing for engagement with a ring gear of an engine when the pinion is urged forwardly, wherein a front end portion at an inner periphery of the pinion is engaged with a spline portion formed at an end of the pinion shaft, and a rear portion of the inner periphery of the pinion is in slidable contact with an outer periphery of the pinion shaft;

a spring interposed between a shoulder portion formed in the pinion shaft and a shoulder portion formed at an intermediate portion of the inner periphery of the pinion to urge the pinion in a direction toward a pinion stopper; and, means for preventing an axial inclination of the pinion relative to the pinion shaft upon urging the pinion shaft outwardly pursuant to engagement between the pinion and the ring gear, and the attendant bending distortion of the spring and a jamming misalignment between the pinion and the ring gear, said preventing means comprising limiting a dimensional clearance between said inner periphery of the pinion and the outer periphery of said pinion shaft to less than 0.1 mm.

2. The starter motor according to claim 1, wherein an oil groove is formed in an inner periphery of the bearing for supporting the pinion shaft.

* * * * *